US009456636B2

(12) United States Patent
Blomberg

(10) Patent No.: US 9,456,636 B2
(45) Date of Patent: Oct. 4, 2016

(54) INSPECTION POCKET FOR BABY GARMENT

(71) Applicant: Emily Elizabeth Emerald Blomberg, Prentice, WI (US)

(72) Inventor: Emily Elizabeth Emerald Blomberg, Prentice, WI (US)

( * ) Notice: Subject to any disclaimer, the term of this patent is extended or adjusted under 35 U.S.C. 154(b) by 322 days.

(21) Appl. No.: 13/973,406

(22) Filed: Aug. 22, 2013

(65) Prior Publication Data

US 2014/0053314 A1 Feb. 27, 2014

Related U.S. Application Data

(60) Provisional application No. 61/692,694, filed on Aug. 23, 2012.

(51) Int. Cl.
*A41B 13/08* (2006.01)

(52) U.S. Cl.
CPC ..... *A41B 13/08* (2013.01)

(58) Field of Classification Search
CPC ..... A41D 13/00; A41D 9/00
USPC ..... 2/80, 83, 79, 69, 69.5
See application file for complete search history.

(56) References Cited

U.S. PATENT DOCUMENTS 2,697,837 A * 12/1954 Goldman ..... A41B 13/005 2/1
2,725,565 A * 12/1955 Wyner ..... A41B 13/00 2/112
3,088,116 A * 5/1963 Simonoff ..... A41D 13/02 2/77
3,711,865 A * 1/1973 Schifman ..... A41D 13/02 2/79
3,852,824 A * 12/1974 Grey ..... A41D 13/02 2/79
3,949,427 A * 4/1976 Sampey ..... A41D 13/02 2/79
3,994,026 A * 11/1976 Sampey ..... A41D 13/02 2/79
4,447,911 A * 5/1984 Marcellaro ..... A41D 13/02 2/79
4,457,025 A * 7/1984 Meryash ..... A41D 13/02 2/79
4,535,480 A * 8/1985 Kunieda ..... A41D 13/02 2/79
4,607,396 A * 8/1986 Craig ..... A41D 13/02 2/247
5,014,356 A * 5/1991 Tomasi-Dubois ..... A41D 13/02 2/79
6,223,352 B1 * 5/2001 Watlington ..... A41B 13/08 2/80
8,359,663 B2 * 1/2013 Blomkwist ..... A41B 13/08 2/111
2007/0266472 A1 * 11/2007 DuFaux ..... A41B 13/005 2/80

* cited by examiner

*Primary Examiner* — Gloria Hale
(74) *Attorney, Agent, or Firm* — Mandy L. Tran

(57) ABSTRACT

A method and device comprising an inspection pocket or viewing slit provided on the backside of an infant onesie wherein a caregiver may quickly, efficiently and cleanly check the contents within an infant's diaper through said slit without having to remove the infant's clothing.

5 Claims, 3 Drawing Sheets

Fig. 1
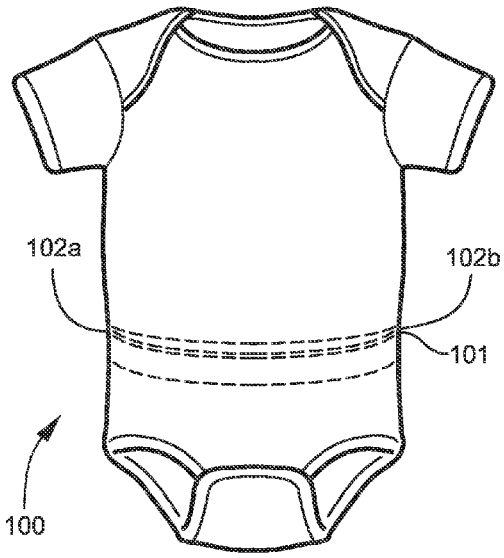
Fig. 2
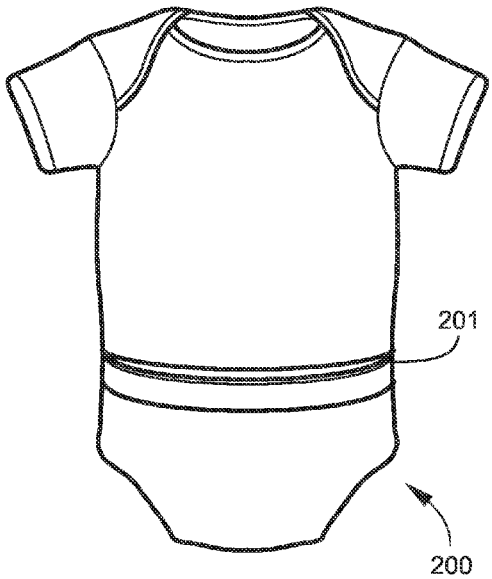
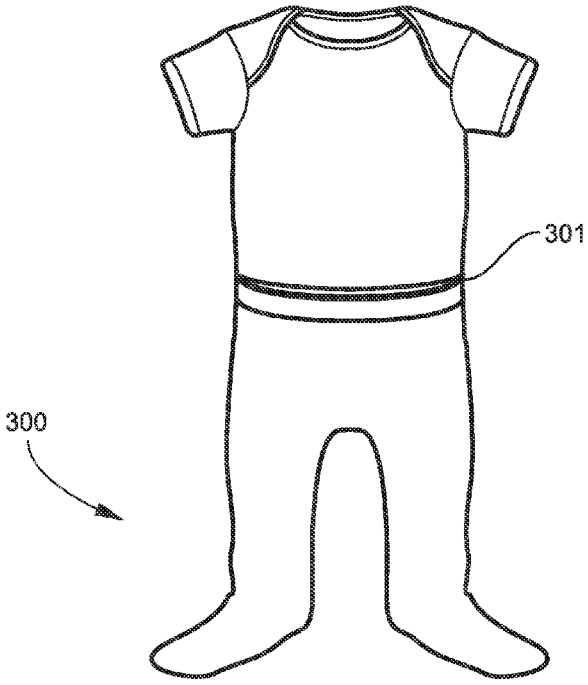
Fig. 3

INSPECTION POCKET FOR BABY GARMENT

CROSS-REFERENCE TO RELATED APPLICATIONS

This nonprovisional utility patent application claims benefit of prior filed provisional patent application pursuant to 35 USC 119(e) and 35 U.S.C. 120 as well as all other relevant statutes not referred to herein, having an earlier provisional filing date of Aug. 23, 2012, Application No. 61/692,694.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark office, patent file or records, but otherwise reserves all copyright rights whatsoever.

FIELD OF INVENTION

This invention pertains to a device and method for changing infant diapers, specifically by way of an infant garment.

BACKGROUND OF THE INVENTION

The invention relates generally to the field of infant or baby apparel, and in particular to the field of single-piece garments or onesies. The onesie, now a customary garment used to clothe children under one year of age, is characterized as a short or long sleeved shirt that extends down over the wearer's buttocks and crotch to snap or otherwise fasten under the crotch. The traditional onesie is regarded as preferable to a shirt and pants because it is prevented from coming loose as the wearer moves about, but the same security hampers the caretaker's inspection of the wearer's diaper for soiling. A shirt and pants, by contrast, allows the diaper to be inspected by pulling back the waistband. What is needed is a garment that combines the advantages of both styles of baby garments.

U.S. patent application Ser. No. 12/030,502 discloses an infant garment having an aperture on the backside of said garment for purposes of reaching upward towards the infant's back in order to rub and sooth an infant to sleep. The purpose of the invention behind this application is unrelated to the purpose of the invention herein. Further, the construction of the claimed device of this patent application to achieve its intended purpose would not effectively achieve the intended purpose of the invention herein.

U.S. Pat. No. 1,525,473 also discloses a sleeper garment having an aperture that comprises a flap, when opened revealing a large open area surrounding the user's backside for easy access toileting. This device is intended for users of all various ages. The purpose of the invention behind this application is unrelated to the purpose of the invention herein. The access flap of this patented invention lacks sufficient overlap between its top and bottom portion to shield against release of excess diaper material. It serves more as a modesty cover with no other inherent useful function. Further, the construction of the claimed device of this patent application to achieve its intended purpose would not effectively achieve the intended purpose of the invention herein.

SUMMARY OF THE INVENTION

Accordingly, the invention herein is directed to a viewing slit for an infant onesie wherein said viewing slit is positioned horizontally on the backside of said onesie. The overall purpose of said viewing slit is to enable a caregiver to quickly, efficiently and cleanly check the contents within a diaper of an infant wearing said onesie garment. In current scenarios, a caregiver is required to remove a child's pants, disconnect the bottom portion of said onesie garment, pull said garment upward above the diaper, and pull the diaper partially apart to view the contents. With this invention, the viewing slit would allow viewing access directly into the diaper through the infant's garment without need to remove any article of clothing. This cuts through substantial amount of time, effort and handling and can be significantly valuable to parents who travel with children and lack space or time to properly check an infant diaper in the current manner. Additional fabric extends over and below the infant's diaper to function as a shield against overflow of excess excrement from said diaper. This overlap compensates for the fact that the viewing slit is positioned in an area where diaper overflow occurs.

The viewing slit is positioned near the lower half of the onesie near the waistline of the garment. It is preferably located approximately three to four inches above the hipline of said garment. The slit comprises a top portion and bottom portion, each portion having an exposed edge. The top and bottom portion is made of soft breathable fabric and are noncontinuous in construction such that a gap opening is located between the two portions. The top portion is positioned behind said bottom portion such that the top portion is in direct contact with the infant's body when the garment is worn. The exposed edge of the top portion extending below the exposed edge of the bottom portion by no less than two and a half inches and no more than four inches in length for an overlapping effect. The exposed edge of the bottom portion further having a collar line along its length that is thicker than the remaining portions of the onesie. The purpose of the thicker collar line is to prevent stretching of said edge with time and use. The collar line should be approximately between one to two inches in width. The bottom portion further having a localizing piece to maintain it stably in place over the top portion so as to prevent sliding of the top portion or leakage of soiling material out of the gap opening. The gap opening between the top and bottom portions is at least the width of an adult person's hand.

The viewing slit of the invention herein being held in stable position when worn by the infant by a localizing piece. Said localizing piece may comprise an elastic band attached along the exposed edge or collar line of the bottom portion dually functioning to provide thickness. The elastic band is preferably one to one to two inches in length to effectively maintain a level of tautness and stability of the bottom portion against the top portion and to maintain closure of the viewing slit while being worn by the infant without use of buttons or other known connecting devices. The lack of connecting pieces or buttons enhances comfort to the infant should they lay asleep on their backside. The opening may be reinforced with additional stitching, layers of fabric, or elastic. Alternatively, the tautness of the bottom portion and its stability against the top portion during use may also be maintained by embedding connector pieces between the exposed edges of the top and bottom portions. Connector pieces may comprise any known standard mechanisms in the art such as but not limited to zippers, buttons or hook and loop type devices.

Another object of this invention is to provide a system for efficiently inspecting an infant diaper through an infant onesie garment in a clean, quick manner that requires minimal handling by the inspecting caregiver. The system comprising a onesie garment having a viewing slit horizontally position along its back portion near the hip region of the garment. An infant's diaper being immediately accessed through said viewing slit wherein the bottom portion of said onesie garment is pulled away from the top portion of said garment and an adult hand is placed downward through said gap opening to access and view the contents of said infant diaper.

Yet another object of this invention is to provide for a system of preventing the release of undesirable diaper content through a viewing slit of an infant onesie garment. The exposed edge of the bottom portion overlaps the exposed edge of the top portion such that the exposed edge of the top portion extends downward behind the exposed edge of the bottom portion to create a protective shield behind the gap opening. The extending top portion having a length no less than two and half inches and no more than four inches from the exposed edge of the top portion, covering the the diaper while it is worn by the infant. The collar line and localizing piece (either combined in one with a stitched elastic band or with separate multiple components) across the bottom portion helps to keep the top portion stably in place to prevent soiled areas along the top portion from sliding out of the viewing slit. The protective shield helps to keep excess diaper content internal to the infant onesie such that immediate release from the diaper through the gap opening is avoided.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

FIG. 1 shows a front view of the first exemplary embodiment.

FIG. 2 shows a front view of the first exemplary embodiment.

FIG. 3 shows a front view of an alternate version of the first exemplary embodiment in use.

DETAILED DESCRIPTION OF THE INVENTION

Reference will now be made in detail to exemplary aspects of the present invention which are illustrated in the accompanying drawings. Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Figure 4:
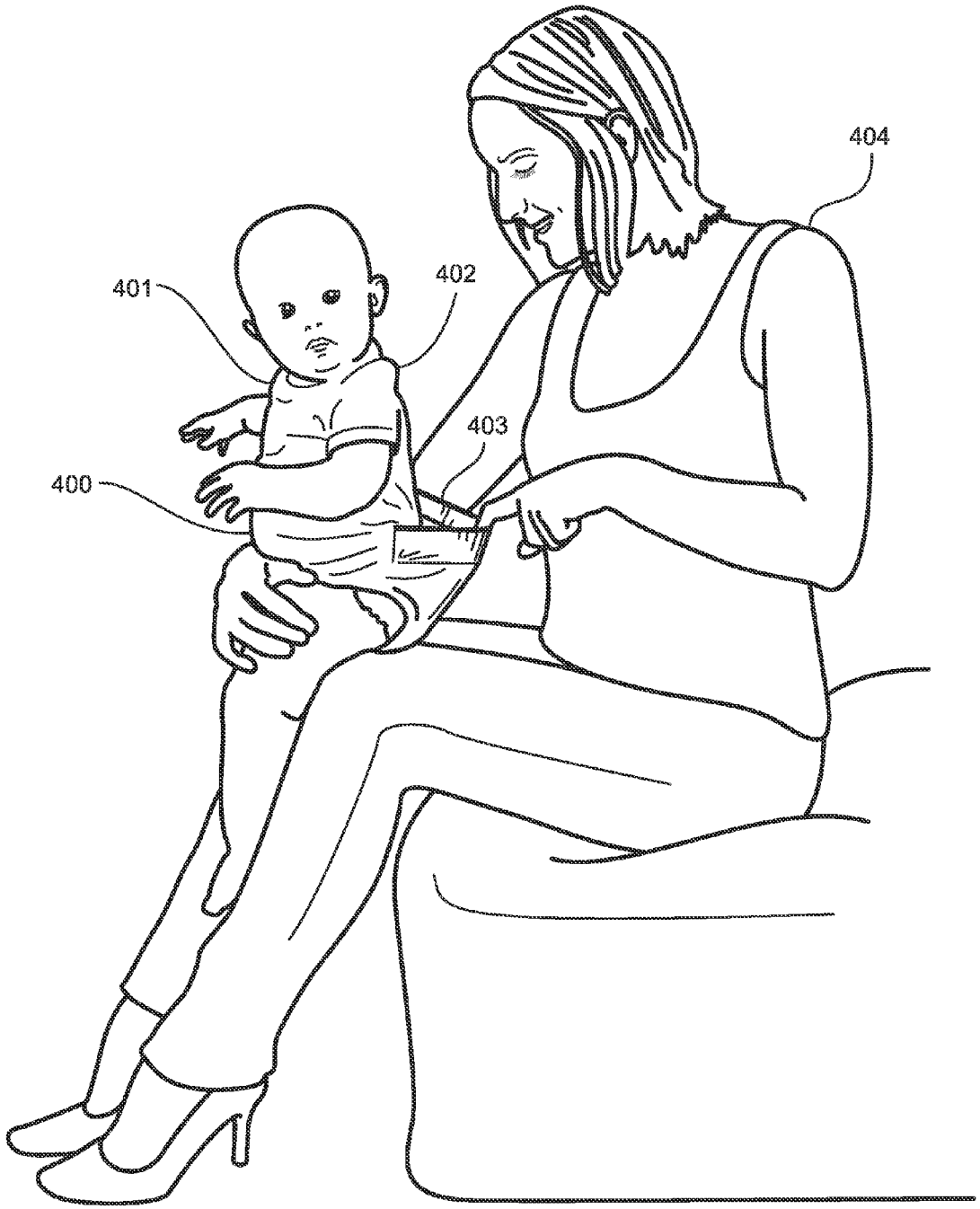
FIG. 4 shows a side view of the first exemplary embodiment.

Referring now to the invention in more detail, the invention is directed to a single piece "onesie" garment 100, 200, 300 as shown in FIGS. 1, 2 and 3 for an infant or baby having a viewing slit 101, 201, 301 through which a caretaker may inspect the wearer's diaper. FIG. 4 shows the first exemplary embodiment of the device and system. In the first exemplary embodiment, a baby onesie 400 is provided. The onesie 400 may be of any design, material, construction, or fastening means of the many known in the prior art. The front of the onesie 401 shown in FIG. 4 is preferably ordinary. The rear of the onesie 402 shown in FIG. 4 features a rear viewing slit 403. The viewing slit 101 extends from one side 102*a* around the back to other side 102*b* at about the wearer's waist. The viewing slit 501 provides an opening 502 directly into the interior of the garment. The exposed edge of the bottom portion 507 of the viewing slit 501 having a thicker collar line 503 that is preferably reinforced with additional stitching, layers of material, or elastic. While the wearer is wearing the onesie 400, a caretaker 404 may pull open the viewing slit 403 to inspect the wearer's diaper for soiling without removing the onesie 400.

Figure 5:
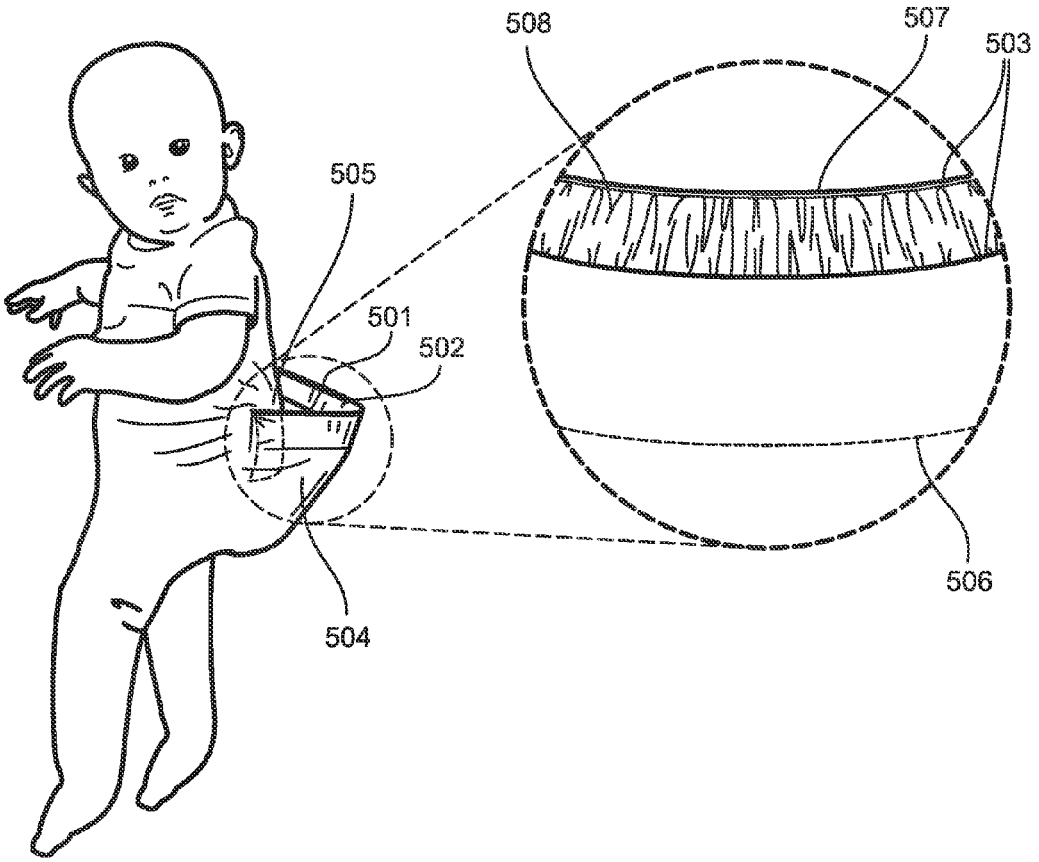
FIG. 5 shows a side view of the first exemplary embodiment.

FIG. 5 shows an exploded view of the first exemplary embodiment of the viewing slit 501 comprising a bottom portion 504 overlapping a top portion 505. Said top portion 505 extending behind and below the bottom portion 504 wherein the exposed edge of the top portion 506 extends no less than two and a half inches and no more than four inches below the exposed edge of the bottom portion 507. The exposed edge of the bottom portion 507 having a collar line 503 from its edge 507 inward by approximately one to one and a half inches. Said collar line 503 having a thickness greater than the thickness of the remaining portions of the onesie 500. The thickness may be achieved by stitching several layers of fabric together along that collar line 503. It may also be achieved by embedding a thicker piece of elastic bad 508 along its length. The first important feature of the exposed edge of the bottom portion being that this collar line 503 has a particular thickness to avoid stretching the edge of the bottom portion 507 over time.

The collar line of the bottom portion may secondly be positioned stably in place over the top portion 505 for purposes of maintaining both top 505 and bottom 504 in place to prevent sliding of soiled fabric or leakage of soiling material. The manner of maintaining the collar line 503 stably in place may be achieved by connecting said collar line 503 of the bottom portion 504 to the top portion 505 of said viewing slit 501. Another method of achieving both desired effects of thickness and stability would be to stitch or embed a thick piece of elastic band 508 along the length of the bottom portion's exposed edge 507. This is the preferred embodiment of this invention because not only would it minimize handling of the viewing slit in a stressful situation, but it also would allow the infant to sleep more comfortably on its backside without uncomfortable lumps or protrusions of connecting pieces against the baby's skin.

FIG. 4 shows the first embodiment of this invention wherein a caregiver is checking into the infant's diaper through the viewing slit 403 without having to remove any portion of the onesie 400. It exemplifies not only the ease of use but also the natural intended positioning of the viewing slit along the length of an infant's back side.

Yet another embodiment of the viewing slit not provided in the illustrations is of the collar line of the bottom portion being stably connected to the top portion by a button. A third and fourth embodiment of the same provides for the collar line of the bottom portion being stably connected to the top portion by a zipper and a loop and hook piece respectively.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

Having fully described at least one embodiment of the present invention, other equivalent or alternative methods according to the present invention will be apparent to those skilled in the art. The invention has been described by way of summary, detailed description and illustration. The specific embodiments disclosed in the above drawings are not intended to be limiting. Implementations of the present invention with various different configurations are contemplated as within the scope of the present invention. The invention is thus to cover all modifications, equivalents, and alternatives falling within the spirit and scope of the following claims.

I claim the following:

1. An infant onesie garment having a top side attached to a bottom side, a front side and a rear side and a viewing slit, said infant onesie garment comprising soft breathable fabric, said viewing slit positioned on said rear side of said infant onesie garment, midway between said top side and said bottom side, said viewing slit comprising an outer portion and an inner portion said outer portion being continuous with said bottom side, said inner portion being continuous with said top side, said outer portion positioned external to said inner portion such that a horizontal opening is located there between, said outer portion positioned behind said inner portion such that the outer portion is in direct contact with the infant's body when the onesie garment is worn, said outer portion having a top edge with a collar line wherein said collar line has a localizing piece comprising a piece of elastic band attached thereto, said collar line having a thickness greater than the thickness of the remaining onesie garment and having a vertical width between one to two inches, said outer portion positioned snugly externally over said inner portion by said top edge and said collar line, said inner portion having a length that extends vertically downward past said top edge of said outer portion such that said outer portion overlaps said inner portion by said length, said length being no less than 2.5 inches and no greater than 4 inches, said horizontal opening being expandable and retractable by said collar line of said top edge, said outer portion and said inner portion being detachably connectable.

2. Said outer and inner portion of claim 1 being detachably connectable along said collar line.

3. Said collar line of claim 1 having a thickness greater than the thickness of the remaining onesie fabric.

4. A method of assessing the cleanliness of a diaper being worn by an infant underneath layers of clothing without need to remove said layers of clothing to access said diaper, wherein said infant is wearing an external layer of clothing over said infant onesie garment of claim 1 and a diaper underneath said infant onesie garment, viewing said diaper directly through said external layer of clothing and said infant onesie garment by first pulling away without removing said external layer of clothing to access said viewing slit, secondly pulling away said collar line of said viewing slit to expand its said horizontal opening, and thirdly upwardly pulling said inner portion by its overlapping extension such that said diaper is accessed and viewable for assessment of its status of cleanliness.

5. A method of assessing the cleanliness of a diaper being worn by an infant underneath layers of clothing without need to remove said layers of clothing to access said diaper, wherein said infant is wearing an external layer of clothing over said infant onesie garment of claim 1 and a diaper underneath said infant onesie garment, viewing said diaper directly through said external layer of clothing and said infant onesie garment by first pulling away without removing said external layer of clothing to access said viewing slit, secondly pulling away said collar line of said viewing slit to expand its said horizontal opening, thirdly upwardly pulling said inner portion by its overlapping extension such that said diaper is accessed and viewable for assessment of its status of cleanliness, further returning said external layer of clothing and said infant onesie garment back to their original position on said infant user by fourth downwardly aligning said overlap extension of said inner portion underneath and internally to said outer portion, positioning said collar line externally over said inner portion of said infant onesie garment, realigning said external layers of clothing over said infant onesie garment on said infant user.

* * * * *